US008459269B2

(12) United States Patent
Zoumut

(10) Patent No.: US 8,459,269 B2
(45) Date of Patent: Jun. 11, 2013

(54) HOOKAH BOWL

(76) Inventor: David Zoumut, San Jose, CA (US)

( * ) Notice: Subject to any disclaimer, the term of this patent is extended or adjusted under 35 U.S.C. 154(b) by 782 days.

(21) Appl. No.: 12/635,874

(22) Filed: Dec. 11, 2009

(65) Prior Publication Data

US 2010/0083973 A1 Apr. 8, 2010

Related U.S. Application Data

(63) Continuation-in-part of application No. 11/400,971, filed on Apr. 10, 2006, now abandoned.

(51) Int. Cl.
*A24F 1/14* (2006.01)

(52) U.S. Cl.
USPC ..... 131/173; 131/194; 131/196

(58) Field of Classification Search
USPC ..... 131/173, 194, 196
See application file for complete search history.

(56) References Cited

U.S. PATENT DOCUMENTS

| | | | | |
|---|---|---|---|---|
| 110,594 | A * | 12/1870 | Selfe | 131/173 |
| 3,881,499 | A | 5/1975 | McFadden et al. | |
| 3,889,690 | A | 6/1975 | Guarnieri | |
| 4,029,109 | A | 6/1977 | Kahler | |
| 4,161,954 | A | 7/1979 | Fornaciari | |
| 4,648,410 | A | 3/1987 | Seroussi | |

* cited by examiner

*Primary Examiner* — Richard Crispino
*Assistant Examiner* — Dionne Walls Mayes
(74) *Attorney, Agent, or Firm* — James Ray & Assoc

(57) ABSTRACT

A side heat bowl for use with a hookah comprising a first receptacle having an interior portion capable of holding a first material to be smoked and a second receptacle having an interior portion capable of holding a second material for providing a heat source for heating the first predetermined material. At least a portion of the sidewall portion of the second receptacle surrounds at least a portion of the sidewall portion of the first receptacle. A plurality of apertures extending through the sidewall of the first receptacle is provided for transferring heat from the heat source to the material to be smoked. At least one aperture is disposed on the bottom portion of the first receptacle for providing fluid communication between the first predetermined material and the hookah.

20 Claims, 4 Drawing Sheets

HOOKAH BOWL

CROSS-REFERENCES TO RELATED APPLICATIONS

This application is a Continuation-in-Part and claims priority from U.S. patent application Ser. No. 11/400,971 filed Apr. 10, 2006 and is hereby incorporated by reference.

FIELD OF THE INVENTION

The present invention relates, in general to the field of hookah bowls and, more particularly, to a side heated hookah bowl.

BACKGROUND OF THE INVENTION

Smoking tobacco in a hookah has been a tradition unchanged for hundreds of years. A hookah is a traditional Middle Eastern or Asian device and is also commonly known as a water pipe, bong, or nargile/nargeela. The hookah consists of four basic parts: the water filled base, which cools and cleanses the fumes by removing tar, nicotine and other undesirable by-products; the bowl, which contains the tobacco or whatever else is being smoked; the pipe, which connects the bowl to the base by a tube that plunges into the water; and the hose, which connects to a second tube in the pipe for transferring the cleansed smoke to the user.

U.S. Pat. No. 4,029,109 to Kahler; U.S. Pat. No. 3,881,499 to McFadden et al; U.S. Pat. No. 4,648,410 to Seroussi; and U.S. Pat. No. 4,161,954 to Fornaciari show various types of hookahs and water pipes known in the art.

The tobacco, or other material to be smoked, located inside the bowl of a hookah is typically heated by charcoal. A layer of aluminum foil is wrapped along the top of the bowl and the charcoal is set on this foil. Perforations are placed in the aluminum. Once the tobacco is lit, the aluminum begins to heat and this heat is transferred through the perforations to the tobacco product within the bowl.

There are several disadvantages that exist with this heating technique. Aluminum is known to produce gases when heated that are harmful to the lungs. Additionally, the charcoal produces ashes that fall through the holes in the aluminum, getting mixed with the tobacco and changing the flavor. Another disadvantage is that the heat is located on top of the tobacco, causing the tobacco to burn quickly resulting in a harsh smoke, and the heat often does not transfer to the tobacco on the bottom of the bowl. Still another disadvantage to this heating technique is the chance of bumping the hookah, causing the hot coals to fall on the floor or the user. Still yet another disadvantage is that the charcoal moves about the top of the foil due to vibration of the hookah during heating, thus one is constantly repositioning the charcoal. Finally, a last disadvantage is that stirring and/or replenishing of the tobacco within the bowl is difficult as one must remove the charcoal and foil from the top of the bowl in order to access the contents therein.

OBJECTS OF THE INVENTION

It is therefore an object of the invention to provide a side heat hookah bowl eliminating the dangerous fumes caused by heating aluminum.

It is yet another object of the invention to provide a side heat hookah bowl that prevents ashes from falling into the tobacco and producing the cleanest smoke and flavor.

It is still yet another object of the invention to provide a side heat hookah bowl that creates an oven like atmosphere that burns the tobacco at a slower rate, producing more smoke and a longer burn time without changing the taste.

It is another object of the invention to provide a side heat hookah bowl that keeps the charcoal contained and prevents accidental spills of the hot coals onto the user or the floor.

It is yet another object of the invention to provide a side heat hookah bowl which eliminates the need for constant monitoring and repositioning of the charcoal due to movement from vibration.

It is an alternative object of the invention to provide a side heat hookah bowl, which eliminates the nuisance, and cost of using a charcoal based heating source.

In addition to the above-described objects and advantages of the side heat hookah bowl, various other objects and advantages of the present invention will become more readily apparent to the persons who are skilled in the same and related arts from the following more detailed description of the invention, particularly, when such description is taken in conjunction with the attached drawing figures and the appended claims.

SUMMARY OF THE INVENTION

Briefly, and in accordance with the forgoing objects, the invention comprises a side heat bowl for use with a hookah comprising a first receptacle having an interior portion capable of holding a first predetermined material to be smoked and a second receptacle having an interior portion capable of holding a second predetermined material for providing a heat source for heating the first predetermined material. Each of the first and second receptacles includes a top portion, a bottom portion, and a sidewall portion extending between the top and bottom portion of the receptacles. At least a portion of the sidewall portion of the second receptacle surrounds at least a portion of the sidewall portion of the first receptacle. A heat transfer means is provided for transferring heat from the second predetermined material within the second receptacle to heat the first predetermined material within the first receptacle. This heat transfer means preferably comprises a plurality of apertures extending through the sidewall of the first receptacle. A means is disposed on the bottom portion of the first receptacle for providing fluid communication between the first predetermined material and the hookah.

The present invention introduces the newest hookah bowl in the market in the last 200 years. This side heat hookah bowl is created and designed for the enjoyment of smoking tobacco in the best and simplest way possible, moving away from the traditional way of smoking. This device results in a much cleaner, crisper, and purer smoke without the taste of aluminum foil, charcoal, and other materials the separate the tobacco from the heat.

BRIEF DESCRIPTION OF THE INVENTION

DETAILED DESCRIPTION OF THE INVENTION

Figure 2:
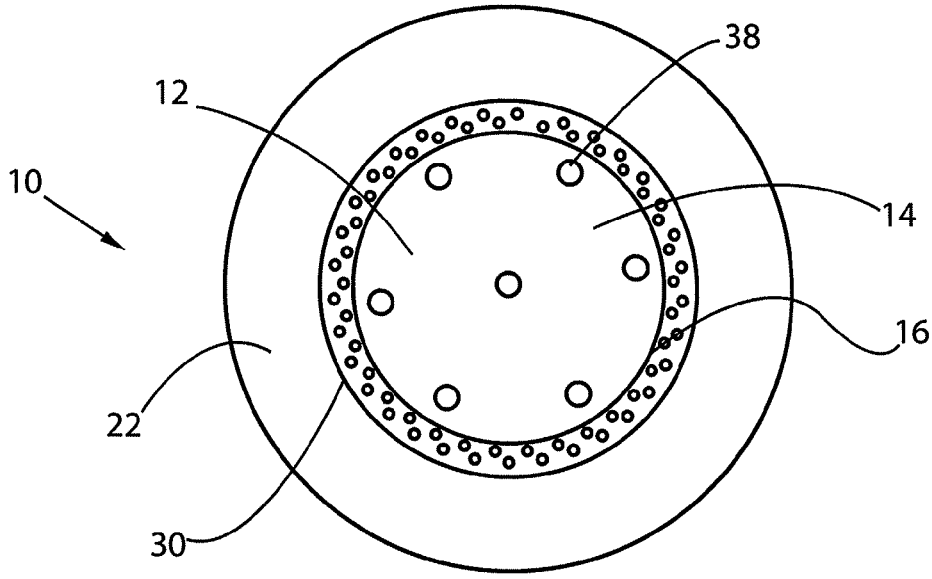
FIG. 2 shows a top view of one embodiment of the side heat hookah bowl of FIG. 1.
Figure 1:
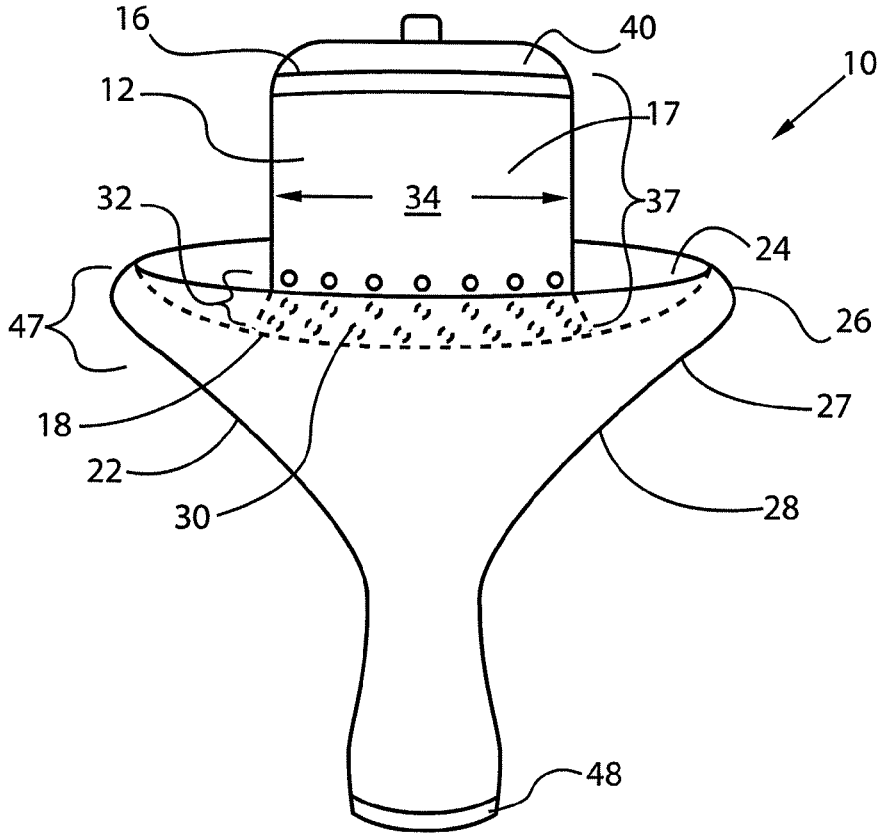
FIG. 1 shows a side view of one embodiment of the side heat hookah bowl of the present invention.

Before describing the invention in detail, the reader is advised that, for the sake of clarity and understanding, identical components having identical functions have been marked where possible with the same reference numerals in each of the Figures provided in this document.

Now reference is made to the Figures, which show the side heat hookah bowl, generally indicated as 10, of the invention. The bowl comprises a first receptacle 12 having an interior portion 14 capable of holding a first predetermined material 15. The first predetermined material 15 is capable of being heated and smoked with a hookah (not shown). The first receptacle 12, has a top portion 16, a bottom portion 18 and a sidewall portion 17 having a predetermined shape extending between the top 16 and bottom 18 portions. A second receptacle 22 is provided which has an interior portion 24 capable of holding a second predetermined material 25, 35. The second predetermined material 25, 35 is capable of providing a heat source for heating the first predetermined material 15. The second receptacle 22 has a top portion 26, a bottom portion 28 and a sidewall portion 27 extending between the top 26 and bottom 28 portions. At least a portion of the sidewall portion 27 of the second receptacle 22 surrounds at least a portion of the sidewall portion 17 of the first receptacle 12.

A heat transfer means 30 is provided for transferring heat from the second predetermined material within the second receptacle 22 to heat the first predetermined material within the first receptacle 12. This heat transfer means preferably comprises a plurality of apertures 30 extending through a portion 32 of the sidewall portion 17 of the first receptacle 12.

Means 38 are disposed on the bottom portion 18 of the first receptacle 12 for providing fluid communication between the first predetermined material and the hookah. Preferably, these means 38 for providing fluid communication comprises at least one aperture extending through the bottom portion 18 of the first receptacle 12.

The predetermined shape of the sidewall portions 17, 27 of the first receptacle 12 and second receptacle 22 can by any well known shape such as cylindrical, rectangular, and polygonal and the like. Furthermore, any other type of shape may be used for decorative purposes, such as a house, animal, and the like, as long as at least a portion of the sidewall 27 of the second receptacle 22 surrounds at least a portion of sidewall 17 of the first receptacle in order to provide a location in which to place the heat source for side heating of the first predetermined material 15 within the first receptacle 12. The present invention should not be limited to embodiments wherein the sidewall 27 of the second receptacle 22 completely surrounds the sidewall 17 of the first receptacle 12 as some designs may only permit heating at certain side locations along the outer perimeter of the sidewall portion 17 of the first receptacle 12 due to a particular design shape.

The sidewall portion 17 of the first receptacle 12 has a first predetermined height 37 and the sidewall portion 27 of the second receptacle 22 has a second predetermined height 47. This first predetermined height 37 of the first receptacle 12 is greater than the second predetermined height 47 of the second receptacle 22. Additionally, the interior portion 14 of the first receptacle 12 has a first diameter 34 and the interior portion 24 of the second receptacle 22 has a second diameter 44. This second diameter 44 of the interior portion 24 of the second receptacle 22 is greater than the first diameter 34 of the interior portion 14 of the first receptacle 12.

The first receptacle 12 can be formed from one of ceramic, clay, glass, metal, metal alloy or any other well-known material. The second receptacle 22 can also be formed from one of ceramic, clay, glass, metal, metal alloy or any other well-known material. The first 12 and second 22 receptacle can also be any color and/or texture as desired for design purposes. Preferably, the first 12 and second 22 receptacle comprises a single piece member.

The top portion 16 of the first 12 and second 22 receptacle is open. A lid 40 may be provided for covering the open top portion 16 of the first receptacle 12.

Figure 3A:
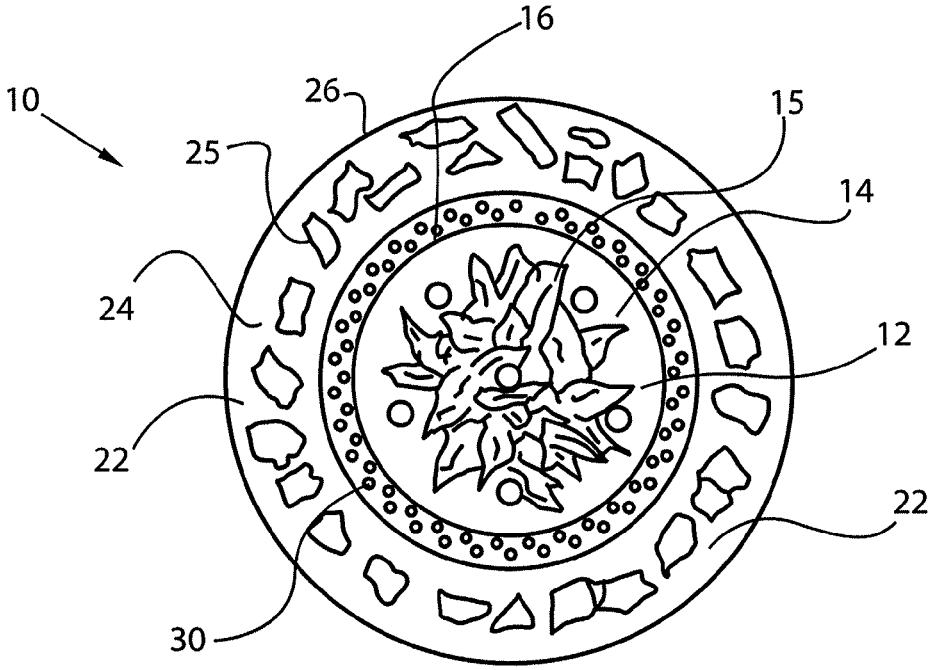
FIG. 3A shows a top view of the side heat hookah bowl of FIG. 2 including the material to be smoked and the means for heating the material according to a first embodiment of the invention.
Figure 3B:
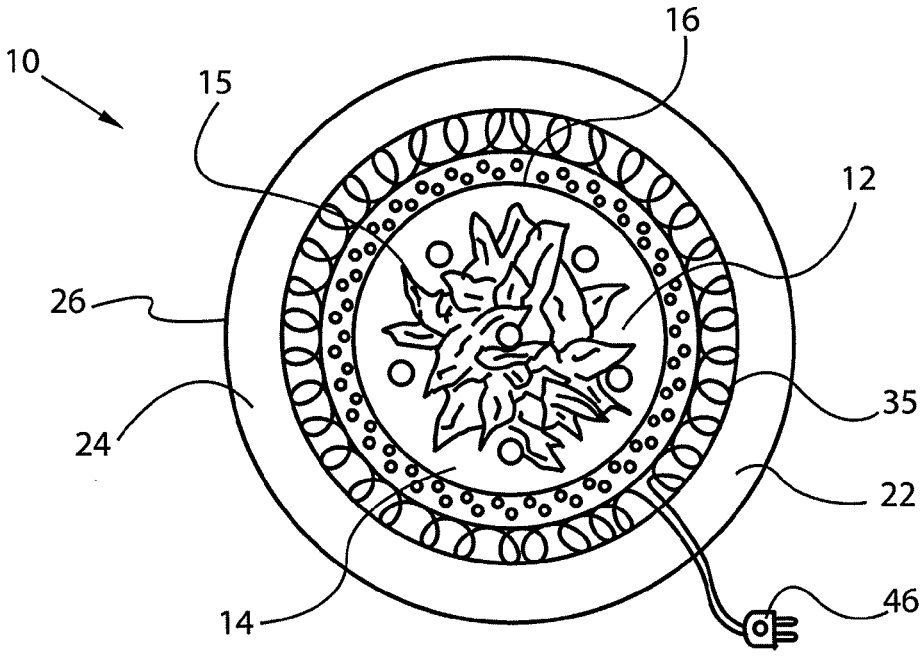
FIG. 3B shows a top view of the side heat hookah bowl of FIG. 2 including the material to be smoked and the means for heating the material according to a second embodiment of the invention.
Figure 4:
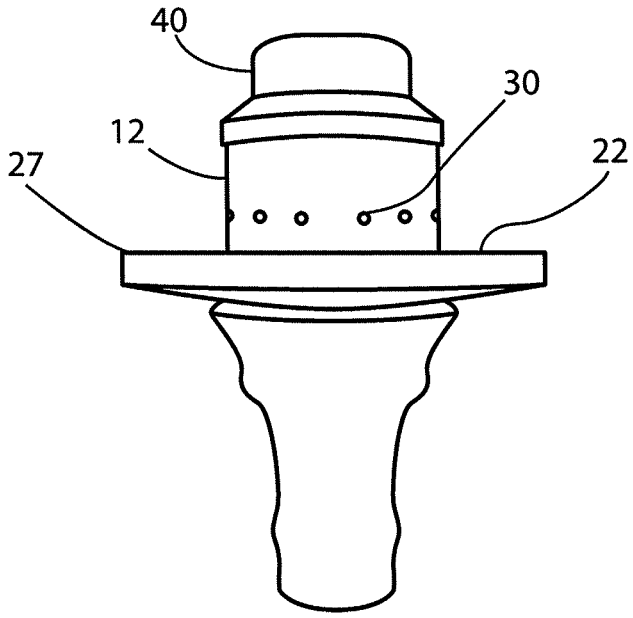
FIG. 4 shows a side view of another embodiment of the side heat hookah bowl as an adapter to a traditional hookah bowl.
Figure 5:
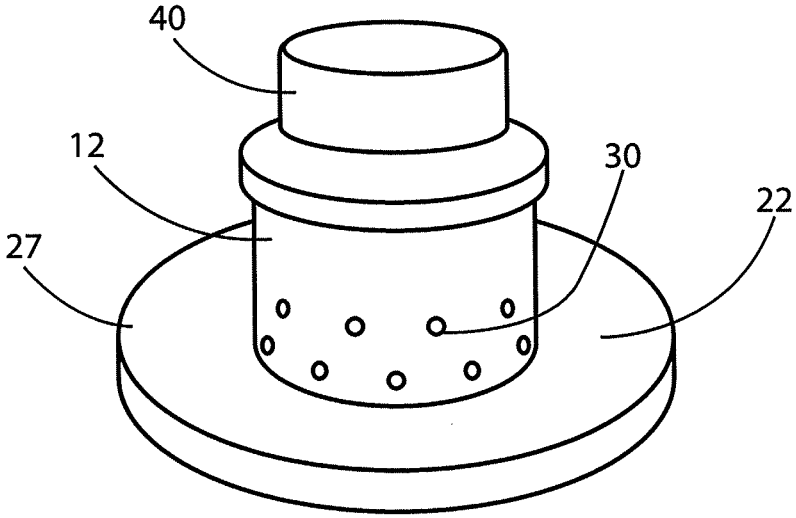
FIG. 5 shows a side view of one embodiment of the side heat hookah bowl of FIG. 4 without the traditional hookah bowl.
Figure 6:
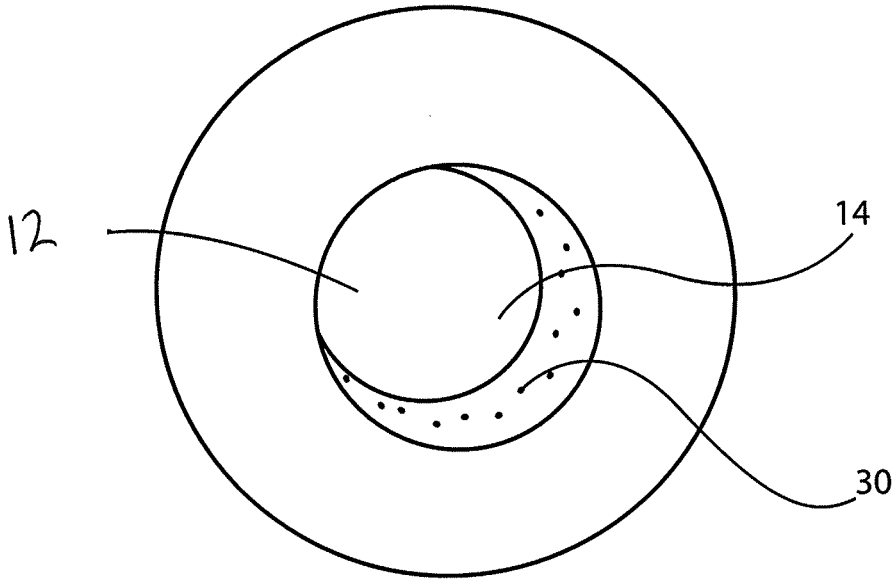
FIG. 6 shows an underside view of one embodiment of the side heat hookah bowl of FIG. 4.
Figure 7:
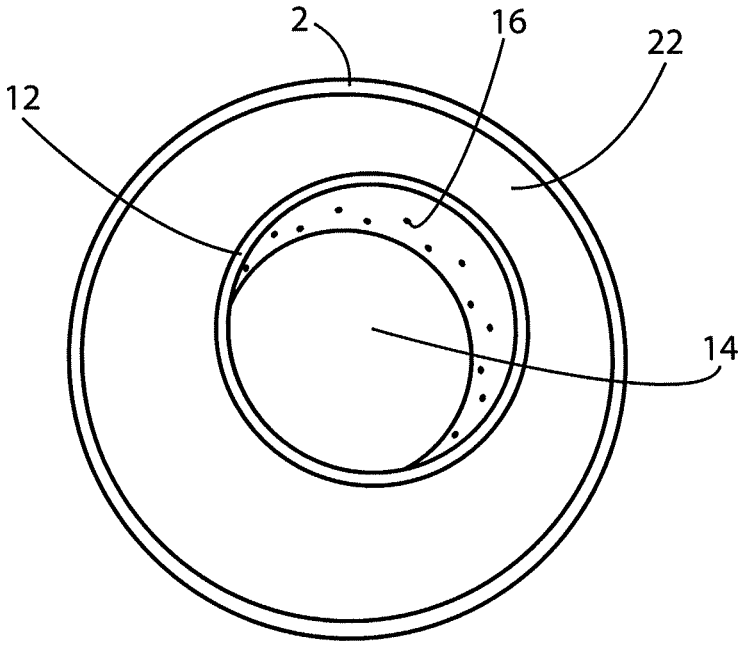
FIG. 7 shows a top side view of one embodiment of the side heat hookah bowl of FIG. 4 without a lid.

As shown in FIGS. 3A and 3B, the first receptacle 12 is capable of holding a first predetermined material 15 comprising one of tobacco material, a tobacco-free alternative material, an herbal mixture, or another other well known material and/or flavor mixture capable of being smoked. As shown in the embodiment of FIG. 3A, the second receptacle 22 is capable of holding a second predetermined material 25 comprising one of a charcoal, and/or an alternative heat source capable of being ignited for heating the first predetermined material 15.

According to a second embodiment, as illustrated in FIG. 3B, the second receptacle 22 is capable of holding a heating coil 35 which surrounds the outer perimeter of the sidewall 17 of the first receptacle 12. A power source 46 is provided for heating the heating coil 35. This power source 46 can be any well known device such as a battery from a battery pack or a car battery, an electrical outlet, and the like.

A sealing means 48 is provided for sealing the bottom portion 18 of the first receptacle 12 to the hookah. This sealing means 48 can comprise any well-known device such as a rubber seal, a grommet, and the like.

The invention has been described in such full, clear, concise, and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

I claim:

1. A side heat bowl for use with a hookah, said bowl comprising:

(a) a first receptacle having an interior portion configured to hold a material capable of being heated and smoked with such hookah, said first receptacle having a top portion, a bottom portion and a sidewall portion having a predetermined shape extending between said top and bottom portion;

(b) a second receptacle having an interior portion, a top portion, a bottom portion and a sidewall portion extending between said top and bottom portion, at least a portion of said sidewall portion of said second receptacle surrounding at least a portion of said sidewall portion of said first receptacle, and a surface of said top portion of said second receptacle abutting a surface of said bottom portion of said first receptacle;

(c) a heat source configured to heat said material;

(d) heat transfer means for transferring heat from said heat source to heat said first predetermined material within said first receptacle; and (e) means disposed on said bottom portion of said first receptacle for providing fluid communication between said material and the hookah.

2. The bowl, according to claim 1, wherein said heat transfer means comprises a plurality of apertures extending through a portion of said sidewall portion of said first receptacle.

3. The bowl of claim 2, wherein said plurality of apertures is disposed adjacent said bottom portion of said first receptacle.

4. The bowl, according to claim 1, wherein said predetermined shape of said sidewall portion of said first receptacle comprises one of cylindrical, rectangular, and polygonal.

5. The bowl, according to claim 1 wherein said predetermined shape of said sidewall portion of said second receptacle comprises one of cylindrical, rectangular, and polygonal.

6. The bowl, according to claim 1, wherein a height of said first receptacle is greater than a height of said second receptacle.

7. The bowl, according to claim 1, wherein a diameter of said interior portion of said second receptacle is greater than a diameter of said interior portion of said first receptacle.

8. The bowl, according to claim 1, wherein said top portion of said first and second receptacles is open.

9. The bowl, according to claim 8, including a lid for covering said open top portion of said first receptacle.

10. The bowl, according to claim 1, wherein said material is one of tobacco material, a tobacco-free alternative material, and an herbal mixture.

11. The bowl, according to claim 1, wherein said heat source is a combustible material.

12. The bowl, according to claim 1, wherein said heat source includes a heating coil and a power source provided for heating said heating coil.

13. The bowl, according to claim 1, wherein said means disposed on said bottom portion of said first receptacle for providing fluid communication between said first predetermined material and such hookah comprises apertures extending through said bottom portion of said first receptacle.

14. The bowl, according to claim 13, further including means for sealing said bottom portion of said first receptacle to such hookah.

15. The bowl, according to claim 14, wherein said means for sealing comprises one of a rubber seal and grommet.

16. The bowl, according to claim 1 wherein said first and second receptacle comprises a single piece member.

17. The bowl of claim 1, wherein said second material is disposed on a surface of said top portion of said second receptacle and surrounds an exterior surface of said sidewall portion of said first receptacle.

18. A side heat bowl adapter for use with a traditional hookah bowl in fluid communication with a hookah, said adapter comprising:

(a) a first receptacle having an interior portion configured to hold a material, capable of being heated and smoked with such hookah, said first receptacle having a top portion, a bottom portion and a sidewall portion having a predetermined shape extending between said top and bottom portion;

(b) a second receptacle having an interior portion, a top portion, a bottom portion and a sidewall portion extending between said top and bottom portion, said at least a portion of said sidewall portion of said second receptacle surrounding at least a portion of said sidewall portion of said first receptacle, and a surface of said top portion of said second receptacle abutting a surface of said bottom portion of said first receptacle;

(c) a heat source configured to heat said material;

(d) heat transfer means for transferring heat from said heat source to heat said material within said first receptacle; and (e) means disposed on said bottom portion of said first receptacle for providing fluid communication between said material and said traditional hookah bowl;

wherein said heat transfer means comprises a plurality of apertures extending through a portion of said sidewall portion of said first receptacle;

wherein said interior portion of said first receptacle has a first diameter and said interior portion of said second receptacle has a second diameter.

19. The side heat bowl adapter, according to claim 18 wherein said second diameter of said interior portion of said second receptacle is greater than said first diameter of said interior portion of said first receptacle.

20. An apparatus comprising:

(a) a first receptacle having an interior portion configured to hold a material capable of being heated and smoked with a hookah;

(b) a second receptacle having a surface thereof abutting a surface of said first receptacle, whereby said first receptacle upstands on said second receptacle;

(c) a heat source configured to heat said material;

(d) first apertures extending through a sidewall portion of said first receptacle so as to transfer heat from said heat source to heat said material; and (e) second apertures extending through said surface of said first receptacle so as to provide fluid communication between said material and the hookah.

* * * * *